United States Patent [19]

Narita et al.

[11] 4,441,832

[45] Apr. 10, 1984

[54] ADAPTIVE HIGH SPEED SERIAL PRINTER

[75] Inventors: Masahisa Narita, Kodaira; Osamu Tomita, Ebina, both of Japan

[73] Assignee: Fujitsu Limited, Kawasaki, Japan

[21] Appl. No.: 361,542

[22] Filed: Mar. 24, 1982

[30] Foreign Application Priority Data

Mar. 30, 1981 [JP] Japan ..... 56-47108

[51] Int. Cl.[3] ..... B41J 1/30; B41J 3/54

[52] U.S. Cl. ..... 400/144.2; 400/149; 400/175; 400/322

[58] Field of Search ..... 400/144.2, 171, 149, 400/150, 151, 175, 322, 279

[56] References Cited

U.S. PATENT DOCUMENTS

| | | | |
|---|---|---|---|
| 4,030,591 | 6/1977 | Martin et al. | 400/144.2 X |
| 4,118,129 | 10/1978 | Grundherr | 400/144.2 |
| 4,232,975 | 11/1980 | Kane | 400/144.2 |
| 4,281,938 | 8/1981 | Phillips | 400/151 X |

*Primary Examiner*—Paul T. Sewell

*Attorney, Agent, or Firm*—Staas & Halsey

[57] ABSTRACT

The present invention relates to a serial printer comprising the mechanism for selecting one type by moving the mounted printing wheel and the carrier for moving said mechanism on the print sheet, has the object that the printing can be done at the maximum speed which is the optimum for the print wheel even in case any kind of printing wheel is mounted and is characterized in that the carrier shifting speed can be changed in accordance with the inertia of printing wheel and a shifting distance of printing wheel.

11 Claims, 6 Drawing Figures

ADAPTIVE HIGH SPEED SERIAL PRINTER

BACKGROUND OF THE INVENTION

This invention relates to a serial printer which realizes printing while moving the print head along the print sheet. This invention particularly relates to a serial printer which mounts a type wheel having a plurality of types on the print head, moves the type selected from the plurality of types to a predetermined position by rotating the type wheel and thereafter prints.

Moreover, this invention relates to a serial printer which realizes printing of a plurality of characters in one line at a high speed by correlating the time for moving the print head and the time for moving the types.

DESCRIPTION OF THE PRIOR ART

A serial printer is known which is small in size and economical, and which sequentially prints the characters by shifting print head along the print sheet and by impacting the selected type to the print sheet.

The print head of such a serial printer usually provides a type wheel having a plurality of type elements or types at its print head a motor having a rotating shaft which mounts the said type wheel and a hammer which is arranged opposite to the rear side of the types on the type wheel for pushing a selected type toward the print sheet.

The serial printer having a print head as mentioned above, employs a motor for rotating the type wheel for printing a selected character and for moving the selected type to the hammering position.

For this reason, it takes time to move the selected type to the hammering position (hereinafter called the selection time).

Changing the selection time is achieved by forming an angle using a straight line connecting the position where the type selected from the type wheel is located and the center of rotation of the type wheel facing the hammer and a straight line passing through the center of rotation of the type wheel. This angle is hereinafter called the selection amount.

In order to move the print head from the current position to a position for printing the next character, a time in accordance with such a distance is required.

In the initial control method of a serial printer, printing is carried out by stopping the carriage at each print position and rotating the wheel only the amount selected while the carriage is moving. This method, however, has the following disadvantage because the carriage is moved intermittently.

Intermittent feed requires that the acceleration control be repeated and deceleration control for each print of a character.

Thus, the print speed can be improved only up to the speed matching the inertia of the carriage.

Japanese Pat. No. 1,013,222 (Examined published patent application SHOWA 53-40,849) by Haruhisa Yamazaki et al. proposed a method, explained below, which eliminated the intermittent feed problem by doing the following:

1. The carriage is not fed intermittently but is moved continuously at a specified speed.

2. The carriage is moved at a speed matching the selection amount.

For example, according to this method, the carriage is moved at maximum speed in case the type to be printed is located at a position next to the type to be impacted by the hammer, and is moved very slowly in case the type to be printed next is located 180° from the type to be impacted by the hammer.

Therefore, the serial printer employing this method has the following effects:

a. The carriage is not placed in a transition condition where it moves to the operating condition from a stop condition and then moves to the stop condition in order to print a character. When the carriage moves to the operating condition from the stop condition, the acceleration control and deceleration control are carried out in the operation condition, and the stop operation is eliminated. This results in printing that can be realized smoothly and at a high speed.

b. When the selection amount is small, the carriage is moved at miximum speed, thus realizing high speed printing.

Meanwhile, the number of types to be accommodated in the wheel is limited by the size of the system.

A wheel by Diablo Corp., for example, currently accommodates 96 characters. However, this number of characters is insufficient for expressing every kind of type such as pica type, elite type, or expressing languages of every country. Therefore the current printer usually requires mounting of a wheel of a corresponding type in order to generate sentences of different types and format. Moreover, recently, type wheel of the same shape are made of different materials. For example, the entire wheel is made of synthetic resin and the surface of the synthetic resin is metal-plated, or the entire wheel is made of a metallic material. When the material is different, the weight is also different even if the type wheel has the same shape.

However, the type wheel controller and carriage controller disclosed in the H. YAMAZAKI patent are designed so that they are suited to the weight of a type wheel. If the type wheel which has the same form but a different weight is mounted, there is a disadvantage in that the specified type is not correctly placed in the specified position because of the difference of inertia of the type wheel. The H. YAMAZAKI patent does not take into consideration changing the print wheel to one which has a different weight.

SUMMARY OF THE INVENTION

Therefore, it is a first object of the present invention to provide a serial printer which can realize printing at the optimum speed for every kind of wheel.

It is a second object of the present invention to provide a serial printer which can realize printing at the maximum speed for every kind of wheel.

It is a third object of the present invention to provide a serial printer which can improve the printing quality and the control method thereof.

Still further objects of the present invention will become apparent from the following explanation.

The present invention optimumly controls the shifting speed of the carriage in accordance with the selection amount of type and the inertia of the type wheel.

DESCRIPTION OF THE PREFERRED EMBODIMENT

Figure 1:
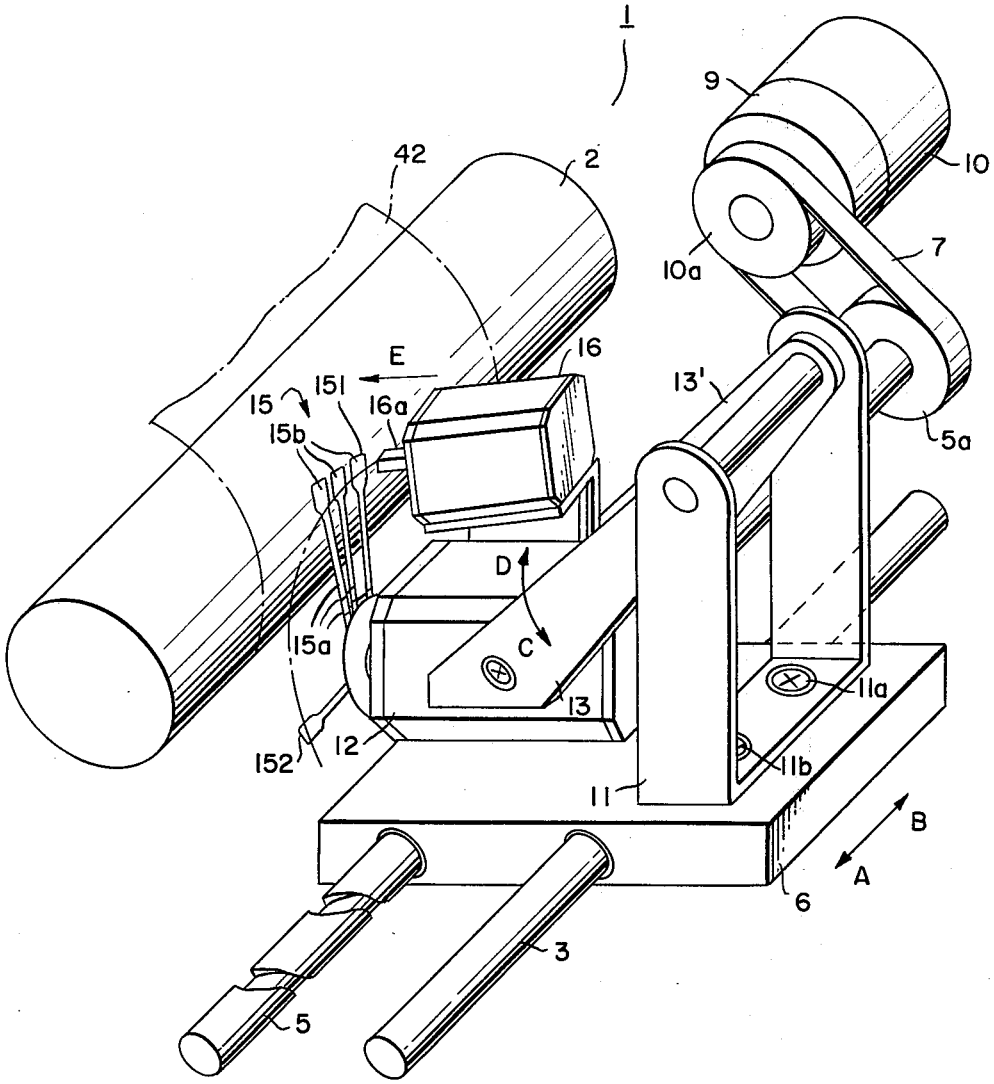
FIG. 1 is a perspective view of a serial printer of an embodiment of the present invention.

FIG. 1 is a perspective view of the serial printer model. In this figure, the serial printer 1 comprises the cylindrical platen 2 and the carriage 6 which provides the print head block and facing thereto.

The carriage 6 is engaged with the guide shaft 3 which has both ends fixed to the frame (not illustrated) so that it is parallel to the platen 2. Thereby, the print head block of carriage 6 can move in parallel with the platen. The carriage 6 is also engaged with the screw shaft 5. The screw shaft 5, having freedom of rotation, connected to the frame and is in parallel with the platen 2. Moreover, at the edge of screw shaft 5, the pulley 5*a* is provided. When the screw shaft 5 rotates, the carriage shifts in the direction indicated by the arrow marked A or B in accordance with the rotating direction of the screw shaft. The rotating shaft of the space motor 10, which gives a rotating force to the screw shaft 5, is connected to the screw shaft 5 through the belt 7 which is extended between the pulley 5*a* and the pulley 10*a* mounted to the rotating shaft.

On the other hand, the U-shaped support 11 is mounted to the carriage 6 by the screws 11*a*, 11*b*. The support 11 is provided with the arms 13, 13', each having one end fixed to the type selection motor 12. The arms 13, 13' are freely rotatable in the directions indicated by the arrow marked C D. The motor 12 is provided with the type wheel 15 which can be mounted or removed. The wheel 15 is provided with many arms 15*a*. The tip of each arm 15*a* is formed with the type element or type 15*b*. At the upper part of motor 12, the print hammer block 16 having the hammer 16*a* which can freely be projected in the direction indicated by the arrow E, is provided.

The print hammer block 16 is mounted to one side of the motor 12 and rotates together with the motor 12 when the arms 13, 13' are rotated.

The hammer 16*a* is projected at such an angle as to cause a facing type to come in contact with the platen.

In addition, the motor 10 for moving the carriage 6 is also provided with a transducer 9.

The transducer 9 generates an analog signal when the motor 10 rotates, corresponding to the rotating angle of the motor. The moving speed of the carriage 6, etc., can be identified by making use of this signal. The control circuit (FIG. 2) is divided into the control system 1*a*, target speed setting circuit 1*b* and hammer control system 1*c*.

In the basic control system 1*a*, the transducer 9 is connected to the position deviation detecting circuit 17, which is connected to the speed signal generating circuit 19 and the position pulse generating circuit 20. The transducer 9 outputs the sawtooth signal S3 in accordance with the rotating position of the motor 10 and its frequency matches the rotating speed of the motor 10. The circuit 17 generates the signal S4 from the sawtooth wave signal, which indicates the deviation from the current position to the target position. The speed signal generating circuit 19 differentiates an output signal S3 of the transducer 9 and generates an envelope signal of the differentiated signal as the speed signal. The position pulse generating circuit 20 slices the signal S4 at the slice level SLV and outputs a position pulse signal PP when the signal S3 becomes lower than the slice level.

The generating circuit 20 is connected to the space end signal generating circuit 21 and hammer activation signal generating circuit 22.

The space end signal generating circuit 21 provides the counter for counting the position pulse signal PP when the space amount SP is input. The space end signal generating circuit outputs the end pulse EP when the count of the position pulse signals 21 correspond to the space amount SP.

The hammer activation signal generating circuit 22 generates the signal for projecting the hammer from the signal PP.

The circuit 20 is also connected to the level converter 23, which supplies the slice signal as described later.

Meanwhile, the circuit 17 and the circuit 19 are connected to the stop control circuit 39. The stop control signal 39 outputs the deceleration signal in order to stop the carriage when the deviation signal crosses the level corresponding to the speed, using the position deviation signal S4 and speed signal S5. In addition, the circuit 19 is connected to the differential amplifier 37. The differential amplifier 37 calculates the difference between the target speed signal given from the target speed setting circuit system 1*b* described later and the current speed signal and then outputs the signal VDS according to the result of the calculation.

The output of the differential amplifier 37 and the output of the circuit 39 are connected to the switch 40. The switch 40 connects the circuit 39 to the amplifier 41 in accordance with an output of the space end detecting circuit 21 described above and connects an output of the differential amplifier 37 to the amplifier 41 during the other period.

The target speed setting circuit system 1*b* comprises the register 27, operation circuit 26, digital analog converter 25, polarity conversion amplifier 35, switch 36 and level converter 23.

The register 27 stores the selection amount data supplied from the external control system. This selection amount data DATA is supplied to the operation circuit 26.

Figure 3:
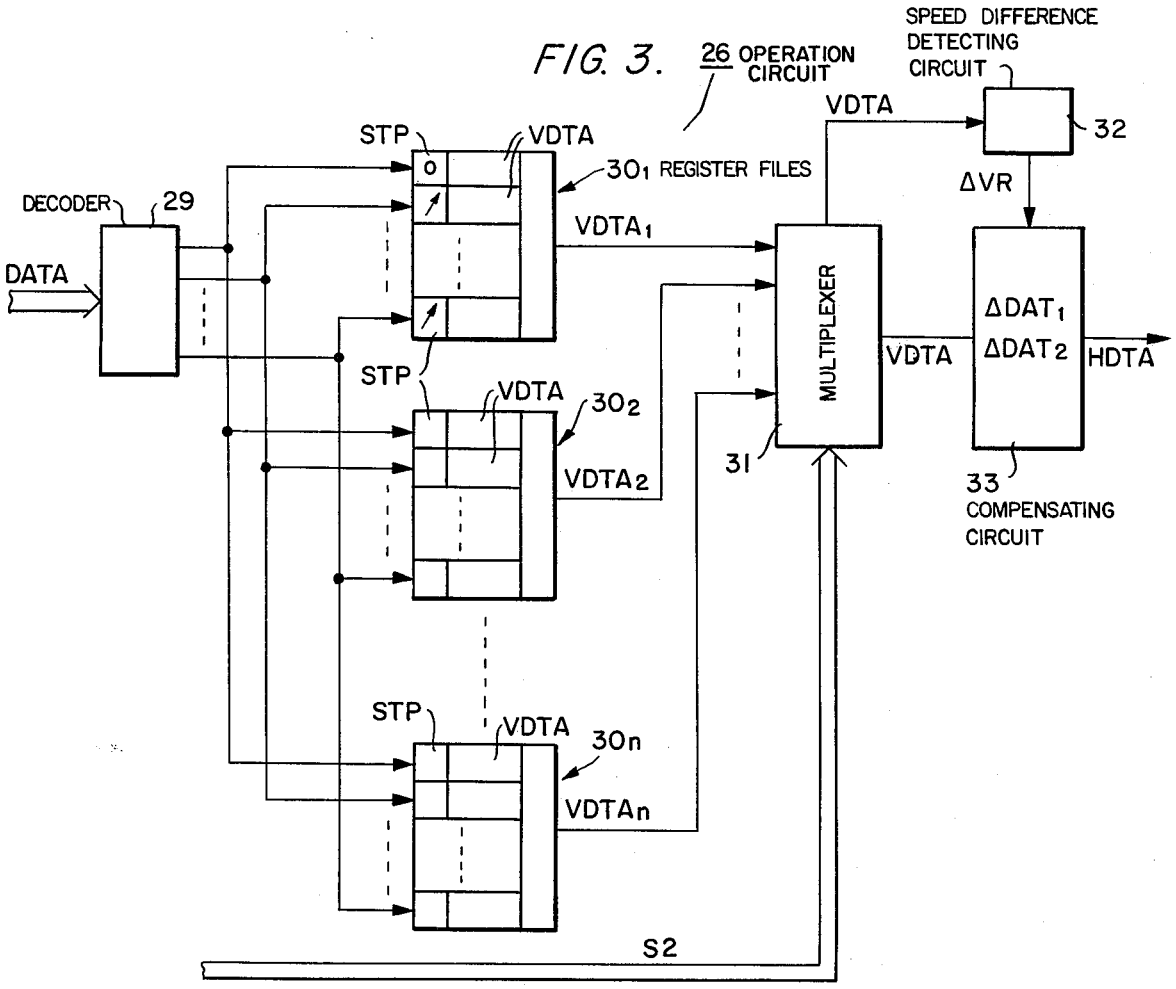
FIG. 3 is a block diagram of the operation of the major part of FIG. 2.

FIG. 3 is a detailed block diagram of the operation circuit 26.

In FIG. 3, $30_1$ to $30_n$ are register files (memory), each corresponding to a different wheel.

Each register file stores, corresponding to each selection amount, the speed voltage data which is obtained by expressing the speed voltage with a digital value.

This speed voltage data considers the respective inertia of each type wheel. Therefore, the register files $30_1$ to $30_n$ respectively store the different speed voltage data corresponding to one selection amount.

Figure 2:
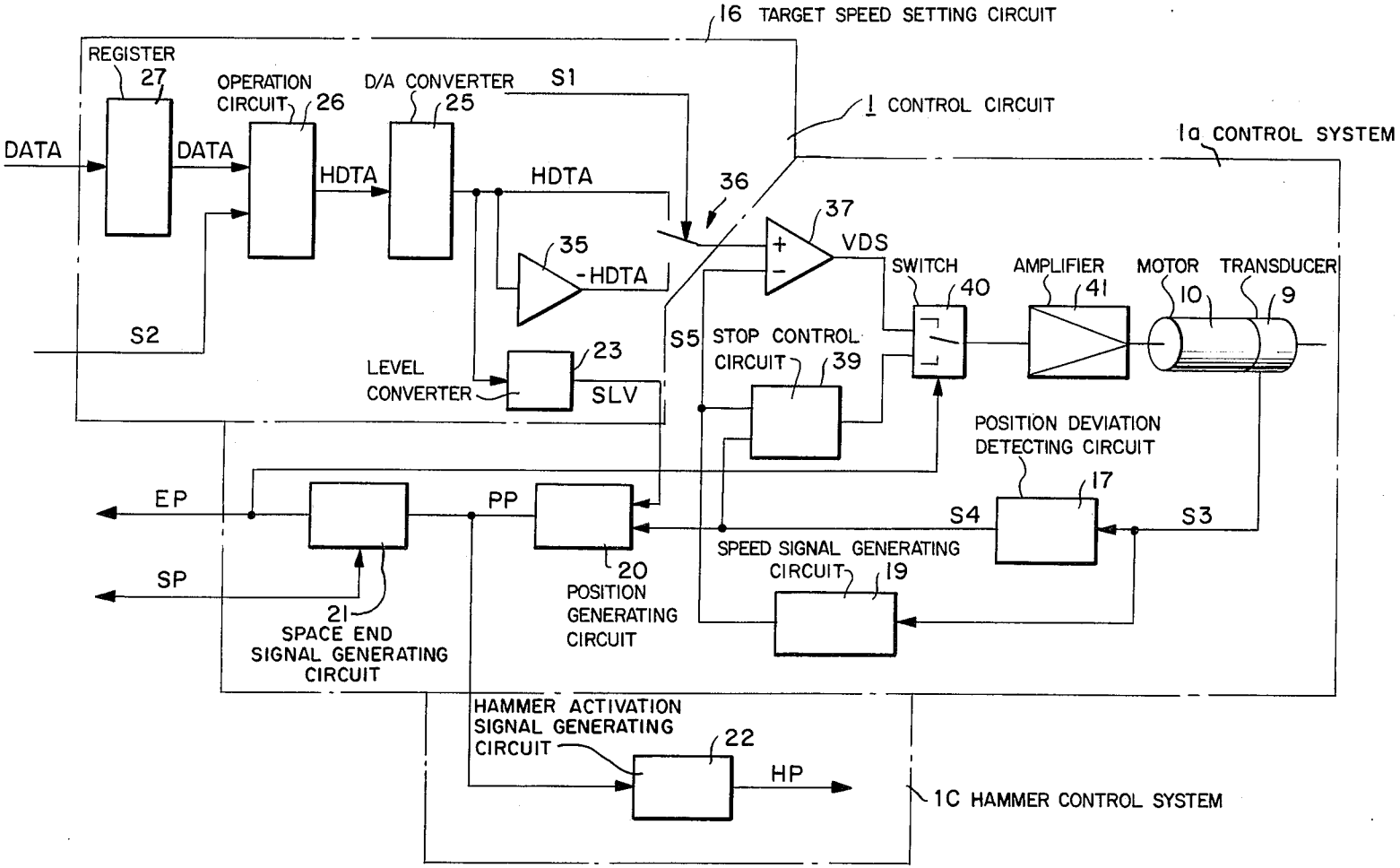
FIG. 2 is a block diagram of the control circuit of an embodiment of the present invention.

The decoder is connected to the register 27 shown in FIG. 2.

The decoder 29 outputs the address data of register files $30_1$ to $30_n$ matching the selection amount data being set in register 27. 31 is the multiplexer which supplies one output signal from the register files $30_1$ to $30_n$ to the speed difference detecting circuit 32 and the compensating circuit 33.

The multiplexer 31 selects one of the output signals VDTA1 to VDTAN in accordance with the data S2 generated by the circuit described later in FIG. 5.

The operation of the serial printer is explained below. In FIG. 1, the serial printer 1 moves, for printing on the print medium 42, the type selection motor 12 in the direction D via the arms 13, 13' in order to mount the type wheel 15 to be used for printing. Then, the print medium 42 is wound around the platen 2. The motor 12 is returned in the direction C and placed on the carriage 6. Print operation can then be started. The control circuit, which is not indicated in FIG. 2, calculates how many steps the type wheel 15 should be rotated from the position of the type 151 which is currently facing the hammer 16*a* to the type 152 to be used for print, and then outputs the result to the switch 36 and selection amount register 27 as the direction signal S1 and selection amount data DATA. The register 27 supplies the data DATA to the operation circuit 26.

Figure 4:
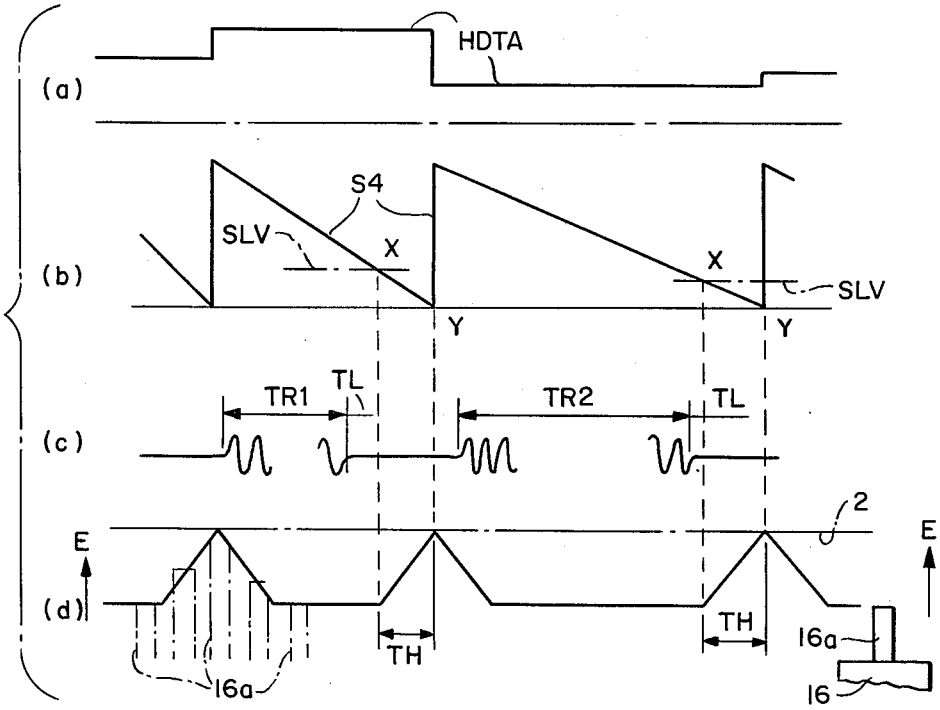
FIG. 4 is a timing diagram of the output signals in FIG. 2.

In FIG. 3, the data DATA sent from the register is output to the register file 30 via the decoder 29. Each register file 30 outputs the selection amount STP of type 15*b* indicated by the data DATA, that is, the speed voltage data VDTA corresponding to the number of steps, to the multiplexer 31. Since the selection signal S2, which indicates in any file 30 the speed voltage data VDTA of the carriage 6 for the type wheel 15 mounted to the type selection motor 12, is being input to the multiplexer 31 from the circuit of FIG. 5 explained later, which discriminates an operator or type wheel 15 being mounted. The multiplexer 31 selects only the speed voltage data VDTA corresponding to the pertinent wheel 15 using the signal S2 and then outputs the signal to the compensating circuit 33 and speed difference detection circuit 32. The speed difference detection circuit 32 and compensating circuit 33 perform the compensating operation, explained later. The compensating voltage data HDTA sent from the circuit 33 is subjected to digital to analog conversion by the D-A converter 25 as shown in FIG. 4 (*a*), and then output to the level converter 23 and inverter 35 (FIG. 2), etc. On the other hand, since the direction signal S1 is input to the switch 36, the switch 36 is set to either the inverter 35 in order to move the carriage 6 in the direction A or to the converter 25 in order to move it in the direction B. Thereby, a signal is input to the differential amplifier 37 by changing the polarity of data HDTA in accordance with the direction of movement of carriage 6. The differential amplifier 37 amplifies a difference between the speed signal S5 indicating the current velocity CV of the carriage 6 and the object speed signal MV designated by the voltage data HDTA and supplies this difference signal to the amplifier 41 via the switch 40. The amplifier 41 supplies a drive signal in accordance with this difference signal, to the space motor 10, causing it to rotate at the specified speed. As a result, the carriage 6 moves in the direction A or B, based on the relation of CV=MV, via the belt 7, pulley 5*a* and screw shaft 5. When the carriage 6 moves, the motor 12 also moves with it, and the amount of movement is output from the transducer 9 to the position deviation detecting circuit 17 as the carriage position signal S3 which is synchronized with the rotation of motor 10. The detection circuit 17 outputs a signal, according to the distance moved by the carriage 6, to the position pulse generating circuit 20 and speed signal generating circuit 19 as the deviation signal S4 shown in FIG. 4 (*b*). The generating circuit 19 differentiates the signal S4 and outputs the current speed CV of carriage 6 to the differential amplifier 37 and stop control circuit 39 as the speed signal S5. Meanwhile, the level converter 23 outputs a constant slice level SLV, in accordance with the voltage data HDTA that has been converted to an analog value, to the generating circuit 20. In FIG. 4, the generating circuit 20 outputs the position pulse PP shown in FIG. 2 to the space end signal generating circuit 21 and hammer activation signal generating circuit 22 at the time X when the signal S4 crosses the level SLV, and a constant time TH before the carriage 6 reaches the print position Y. On the other hand, the type selection motor 12 is also rotated on the basis of the selection amount data DATA, causing the type 15*b* to be placed face to face with the hammer 16*a*. However, as shown in FIG. 4 (*c*), the selection times $TR_1$ and $TR_2$ are required until the motor 12 starts the selecting operation and rotates the specified selection amount (one cycle in the figure corresponds to the amount of rotation of one step of the wheel 15), positioning the object type 15*b* with the hammer 16*a*. However, since the carriage 6 is driven according to the speed voltage data VDTA which is related to the inertia of the type wheel 15, the selecting operation of wheel 15 is completed irrespective of the selection amount, before the carriage 6 passes the point X in FIG. 4. In other words, when the selection amount is large, the speed of the carriage 6 is generally lowered because longer selection times $TR_1$ and $TR_2$ are required (in this case, the compensating voltage data HDTA based on the speed voltage data VDTA is certainly small), and when the selection amount is small, the speed of the carriage is raised for improving print speed because the selecting times $TR_1$ and $TR_2$ can be made short (the voltage data VDTA, HDTA are large). When the inertia of wheel 15 is large even when the selection amount is equal, the selection times $TR_1$ and $TR_2$ become longer. Therefore, the selection operation of type 15*b* is already completed before the time TH when the carriage 6 reaches the print position Y by lowering the shifting speed of carriage 6 (therefore making the voltage data VDTA and HDTA small). Moreover, since small inertia makes the selection times $TR_1$ and $TR_2$small, the print speed is improved by making the speed of the carriage 6 fast (therefore making the voltage data VDTA and HDTA large) and a small idle time TL, the time from the end of the selection of type 15*b* to the drive of print hammer 16, results. On the other hand, when the position pulse PP is input to the activation signal generating circuit 22, it outputs the hammer activation signal HP in order to drive the print hammer 16. Thus, the hammer 16*a* is projected in the direction E as shown in FIG. 1 and FIG. 4(*d*), causing the type 15*b* to be used for print on the type wheel 15 to be pressed to the printing medium 42 on the platen 2 for printing. Since the time TH is required until the pulse PP is output and printing is carried out on the medium 42, the type 15*b* is accurately impacted to the printing position Y from the carriage 6 which is being shifted in the direction A or B. The space end signal EP (FIG. 2) is output from the end signal generating circuit 21 by the position pulse PP, the switch 40 is set to the stop control circuit 39, the space motor 10 enters the stop control circuit to stop the carriage 6 at the print position Y. In case there is a character to be printed next, the space start signal SP is immediately input to the generating circuit 21, setting the switch 40 to the amplifier 37. Thus, the carriage 6 is virtually shifted continuously. The selection amount data DATA is output to the register 27 for each print of type 15*b*, and the operation circuit 26 outputs for each print the speed voltage data VDTA, in accordance with the selection amount, to the speed difference detecting circuit 32 and the compensating circuit 33. The speed difference detecting circuit 32 outputs a difference ΔVR between the object speed MV' of carriage 6 designated by the data DATA in the immediately preceding selecting operation and the object speed MV of the carriage designated by the data DATA in the current selecting operation. The compensating circuit 33, which considers the effect of inertia of carriage 6 which is shifting at the speed MV' in the preceding selection operation and is to be applied to the shifting speed of carriage 6 during the current selecting operation, calculates the amount of compensation $\Delta DAT_1$ and compensates the data VDTA so that the carriage 6 can accurately move at the object speed MV. In addition to the compensation amount $\Delta DAT_1$, the compensating circuit 33 calculates a compensation amount $\Delta DAT_2$ in accordance with the difference between the preceding print position Y and the next print position Y and further compensates the speed voltage data VDTA. When the print character space is usual, the carriage 6 is moved at the ordinary object speed MV considering the selection times $TR_1$ and $TR_2$ of the wheel 15, but when the print character space is wider, the type wheel 15 can select the types using space shifting time. Therefore, in this case, the print speed can be improved by increasing the speed MV over the ordinary speed. Consequently, the compensating circuit 33 generates the compensating voltage data HDTA in such a form that the compensating amounts $\Delta DAT_1$ and $\Delta DAT_2$ are superimposed on the speed voltage data VDTA and outputs it to the D-A convertor 25.

Figure 5:
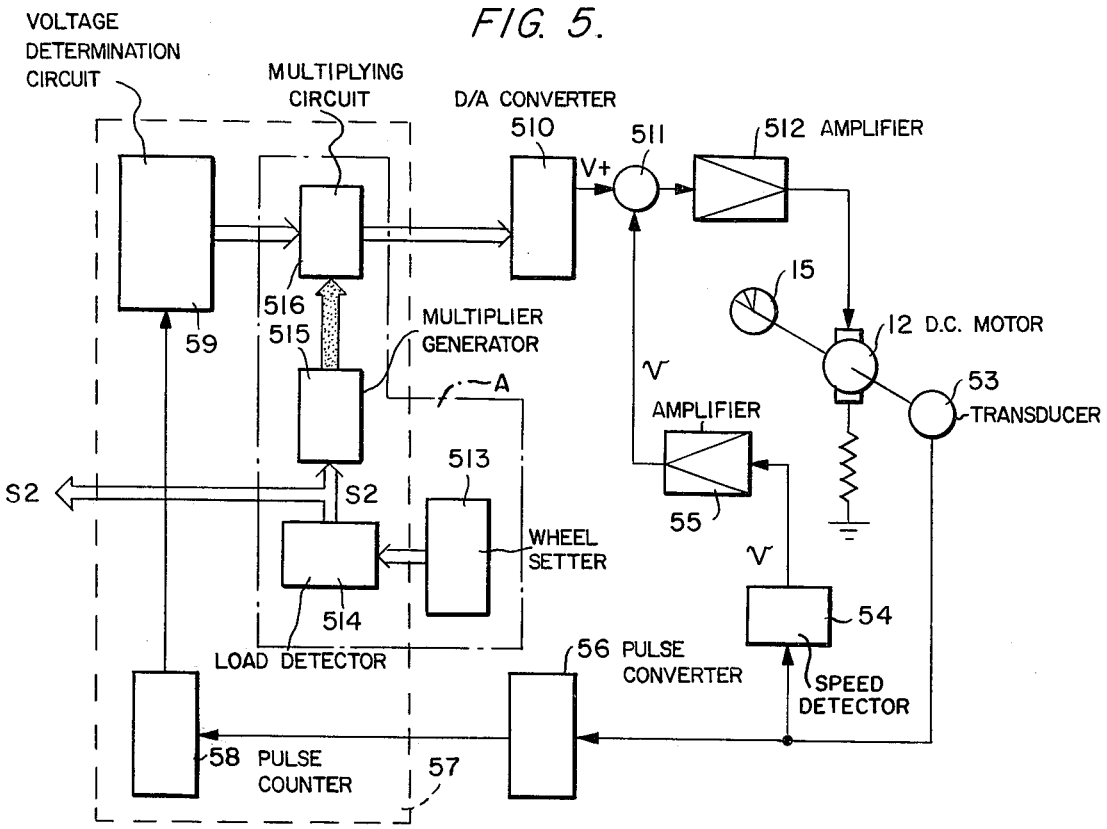
FIG. 5 is a block diagram of the circuit for generating the selection signal S2 in FIG. 2.

FIG. 5 is a block diagram of the circuit mentioned above for generating the signal S2. In this figure, 53 is the transducer for generating the rotating position signal, for example, the sine wave signal in which the zero position indicates the position of the type of type wheel 15. This rotating position signal is usually detected from a synchronized signal plate mounted to the shaft of the DC motor 12. 54 is the speed detector which detects the actual rotating speed v in the DC motor 12 from the rotating position signal and generates the type speed signal v having a DC voltage level v corresponding to this v (the actual rotating speed v and the speed signal v have the same characteristics and are not confused even if the symbol v is used). 55 is the amplifier for amplifiying the speed signal v. 56 is the pulse converter which generates the position pulse for each type position from the rotating position signal. This position pulse can be obtained by generating a pulse for each zero point of the sine wave signal which is the rotating position signal. This position pulse is generated for each type on the type wheel in synchronization with the position signal.

In the control system 57 enclosed by the dotted line is a pulse counter 58 which counts the position pulse and generates the timing signal for the desired type to be printed and supplies it to the DC motor drive basic voltage determination circuit 59. The DC motor drive basic voltage determination circuit 59 supplies digital voltage data, indicating a drive voltage for the DC motor 12 to stop the desired type at the specified position, to the D/A converter 510. The D/A converter 510 converts this digital voltage data into a DC voltage and then supplies it to the comparator 511. 512 is an amplifier which supplies the DC voltage generated from the comparator 511 and to the DC motor 12. 513 is the wheel setter, for example, comprising a changeover switch. 514 is a load detector. 515 is a multiplier generator which generates the multiplier K. 516 is a multiplying circuit.

Figure 6:
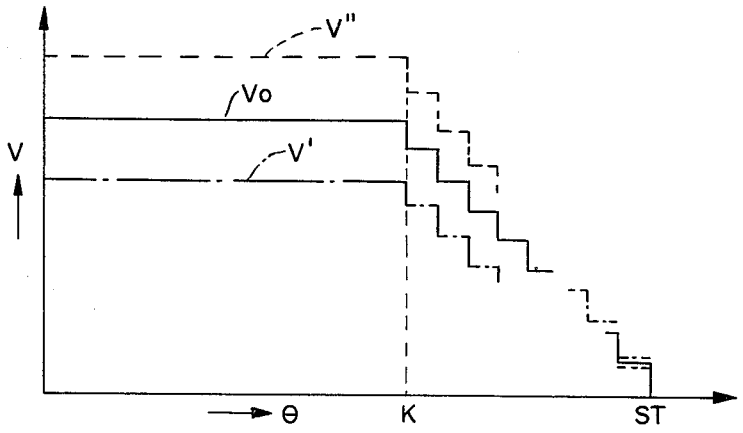
FIG. 6 is a graph of the selection amount vs. basic voltage characteristics for explaining the operation of FIG. 5.

Prior to an explanation of FIG. 5, the operation of the existing type wheel drive control circuit except for that indicated by the broken line of FIG. 5, is explained together with FIG. 6.

FIG. 6 shows the DC motor drive basic voltage V (vertical axis) obtained by converting a voltage data generated by the DC motor drive basic voltage determining circuit 59 into a DC voltage by the D/A converter 510. The horizontal axis of this figure indicates the rotating angle of the DC motor 12, that is, the selection amount of type $\theta$. The point ST indicates the specified stop position of the desired type. A type is stopped at the specified point ST and impacted by the print hammer for printing. In order to stop a type at this point ST, the DC motor 12 is driven at a constant speed up to the point K before the point ST usually by a distance of four to five characters. Then, the drive voltage is lowered gradually in the form of a stair-case from the point K and becomes zero at the point ST. In general, such a stair-case is divided into 14 steps in order to realize a smooth stop for the motor. Since the speed of DC motor 12 is regulated by the DC motor drive basic voltage V, set-up speed signal V for the DC motor 12 matches the characteristics of the DC motor drive basic voltage V (the same symbol V is used as in the case of the speed signal v because they are not confused).

The pulse counter 58 counts the position pulses, corresponding to the type, generated by the transducer 53 and pulse converter 56, generates the timing signal for each count of the position pulse and generates the modified timing signal when the counting is continued up to the point of the specified number of characters (for example, 14 to 15) before the desired type. The DC motor drive basic voltage determining circuit 59 and D/A converter 510, as explained above, generate a constant voltage up to the point K, receive the modified timing signal and the drive voltage which is reduced step by step after the point K, (that is, the set-up speed signal V) and then supply the set-up speed signal V to the comparator 511. On the other hand, an actual speed signal v of the DC motor 12 is applied to the comparator 511 from the amplifier 55. The comparator 511 supplies a DC voltage representing the difference between the actual speed signal v and the set-up speed signal V to the DC motor 12. When the set-up speed signal V is higher than the actual speed signal v, the DC voltage supplied to the DC motor 12 increases, raising the actual speed signal v. When the set-up speed signal V is lower than the actual speed signal v, the DC voltage supplied to the DC motor 12 is lowered, reducing the actual speed signal v. Thus, control is performed so that the actual speed signal of DC motor 12 matches the set-up speed signal V.

Such a servo control system is designed so that it is not influenced by a little change of weight of the type wheel load and is capable of controlling the set-up speed signal V and the actual speed signal v so that they match. Correct control is no longer possible if the weight of the type wheel changes greatly. Of course, in case the servo system is designed with sufficient capacity, control is possible even when a load becomes large, but it is not desirable as explained above.

The inventors of the present invention searched for the cause of the difficulty regarding the speed control when the weight of the type wheel, which is a load, changes they found that it is mainly caused due to a change of inertia and therefore accurate control can be accomplished if the weight of the type wheel is different when the same type wheel drive control system is used by keeping the inertia equal if the weight of the type wheel is changed. In other words, the inventors have found that if the weight of the type wheel changes, stable and accurate speed control is possible through such a control that when a heavy type wheel is used, the drive voltage of the DC motor is reduced (i.e. V' of FIG. 6, by a certain rate as compared with that of a light type wheel, and the inertia is kept the same by lowering the maximum speed.

In this structure, when the type wheel, which is a load, changes, an operator changes the switch of the wheel setter 513 to the pertinent type wheel. The load detector 514 detects the kind of type wheel load from the setting position of the wheel setter 513 and generates a corresponding control signal S2. The multiplier generator 515 receives the control signal and generates the multiplier K (the value of K changes in accordance with a change of type wheel) corresponding to the type wheel load specified. The multiplication circuit 516 adds the weight of K to the digital voltage data indicating the drive voltage generated from the DC motor drive basic voltage determination circuit 59. As a result, the DC motor drive basic voltage V generated from the D/A convertor 510, that is, the set-up speed signal V, is multiplied by the multiplier K.

Therefore, stable and accurate speed control can be realized by changing the multiplier K in accordance with the kind of type wheel load and making the inertia of each kind of type wheel equal. However, the case cannot be limited only to a change of inertia and therefore compensation is actually required for each system. The compensation required is determined experimentally, for example, when the type wheel weight is lightest, K=8 (FIG. 6, V), standard, K=7 (FIG. 6, $V_0$), or heaviest, K=6 (FIG. 6, V'). In these cases, sufficient speed control can be realized with a change of speed sufficient for practical operation. It is not practical that a change of speed become large when a type wheel changes. Therefore, it is necessary to determine the control capability of the servo mechanism and a value of the multiplier K so that the speed change can be kept within a practical range. The control capability of the servo mechanism may be determined with reference to the lightest load. It is also possible to integrate the wheel setter 513 and the load detector 514.

In the above explanation, as an example of a different type of type wheel load, the weight is different in the same shape. But when the shape is different, for example, in when the number of types is different, the above explanation can also be adapted. When a type wheel having a different number of types is used, the synchronized signal plate, (not illustrated) of the transducer 53 must be changed simultaneously. Moreover, when the number of types changes greatly, it is also necessary to control the generating position of the modified timing signal generated from the pulse counter 58 by means of the load detector 514.

It is also possible to configure the wheel setter to be directly connected to the circuits shown in FIG. 2.

According to the present invention, as explained above, a unit of a type wheel drive control system can use different kinds of type wheels by lowering the speed in accordance with the type wheel having a heavy load. In this case, moreover, it is enough for the servo mechanism to have the capability of controlling ordinarily the lightest load. Thereby, it is possible to reduce the size of the system as a whole, realize high efficiency, and economize.

In addition, the present invention changes the shifting speed of the carriage 6 in accordance with the inertia at the time of selecting the kind of print head of the type wheel 15. It is now possible to freely change the print head having a diversified inertia for the same serial printer 1, contributing to expansion of the kinds of types for printing of the printer 1 and an improvement of print quality.

We claim:

1. An adaptive high speed serial printer operatively connected to an external source having a selection amount data, for printing on a record media, comprising:

a platen for supporting the record media;

a carrier for traversing back and forth along said platen;

a printing wheel, selected from a plurality of printing wheels, mounted on said carrier, said printing wheel having a plurality of type elements;

selecting means, mounted on said carrier, for moving a selected one of said plurality of type elements to a hammering position located in front of said platen by rotating said printing wheel;

hammering means for impacting said selected one of said plurality of type elements with said platen;

spacing means, coupled to said carrier, for correctly spacing said carrier along said platen at a spacing speed in dependence upon a command signal; and control means, operatively connected to receive the selection amount data from the external source, comprising:

selecting control means for controlling the movement of said selecting means so as to rotate said selected one of said plurality of type elements to the hammering position between said hammering means and said platen in accordance with the selection amount data which indicates the distance from the present position of said selected one of said plurality of type elements to said hammering position;

hammer control means, connected to said hammering means, for controlling the impact timing of said hammering means;

signal generating means for generating a signal corresponding to the inertia of said printing wheel, selected from said plurality of printing wheels, mounted on said carrier; and carrier control means, operatively connected to said signal generating means, said spacing means and the external source, for generating the command signal for controlling the spacing speed of said carrier as it moves along said platen, the command signal being generated in accordance with the selection amount data and the signal corresponding to the inertia of said printing wheel.

2. An adaptive high speed serial printer according to claim 1, wherein said selecting control means comprises speed selecting means for rotating said selected one of said plurality of type elements at a selected speed in accordance with the inertia of said printing wheel, and wherein said selecting control means controls said selecting means to move said printing wheel at said selected speed.

3. An adaptive high speed serial printer according to claim 2, wherein said speed selecting means comprises input means for providing data corresponding to said selected one of said plurality of type elements of said printing wheel to said selecting means, and wherein said speed selecting means rotates said selected one of said plurality of type elements at the selected speed in accordance with the inertia of said printing wheel and said data provided by said input means.

4. An adaptive high speed serial printer according to claim 2, wherein said carrier control means is operatively connected to said selecting control means, wherein said selecting control means further comprises input means for providing data corresponding to said selected one of said plurality of type elements of said printing wheel to said selecting means, and wherein said speed selecting means rotates said selected one of said plurality of type elements at the selected speed in accordance with the data provided by said input means.

5. An adaptive high speed serial printer according to claim 1, wherein said carrier control means further comprises input means for providing data corresponding to said selected one of said plurality of type elements of said printing wheel to said selecting means, the data corresponding to the inertia of said printing wheel, and wherein said carrier control means controls said spacing means so as to move said carrier at a spacing speed in accordance with the selection amount data and the data corresponding to said selected one of said plurality of type elements.

6. An adaptive high speed serial printer according to claim 1, wherein said carrier control means further comprises difference signal generating means for generating a difference signal corresponding to a distance from a present position of said carrier to a position of said carrier along said platen, and wherein said hammer control means controls a hammering time of said hammer means in accordance with the level of the difference signal.

7. A control circuit for an adaptive high-speed serial printer including a type wheel selected from a plurality of type wheels, each having an inertia and a plurality of type elements each of which has a corresponding selected speed data, hammering means, a carriage, and a transducer for generating an analog signal indicating a distance between the present position of the carriage and the object position of the carriage, the control circuit being operatively connectable to an external control system which provides a selection amount data, comprising:

a position control circuit, operatively connected to the transducer and the carriage, for receiving the analog signal, for generating a position pulse signal, and for controlling a spacing speed of the carriage as it moves from the present position to the object position in dependence upon the inertia of the selected type wheel and the selection amount data;

a hammer control circuit, operatively connected to said control system and the hammering means, for receiving the position pulse signal and activating the hammering means when the moving carriage is passing the object position; and a target speed setting circuit, operatively connected to said position control circuit, for receiving and storing the corresponding selected speed data for each of the plurality of type elements of the type wheel and for generating the spacing speed signal to said position control circuit to control the carriage as it moves from the present position to the object position, comprising:

a register, operatively connected to the external control system, for storing the selection amount data from the external control system and outputting a selection amount data signal.

8. A control circuit for an adaptive high-speed printer according to claim 7, wherein said position control circuit comprises:

a position deviation detecting circuit, operatively connected to the transducer, for receiving the analog signal and outputting a deviation signal indicating the present position of the carriage relative to the object position;

a speed signal generating circuit, operatively connected to said position deviation detecting circuit, for receiving the deviation signal and generating a speed signal;

a position pulse generating circuit, operatively connected to said position deviation detecting circuit, for receiving the deviation signal and generating the position pulse signal;

a space end generating circuit having a counter, operatively connected to said position pulse generating circuit, for receiving and counting the position pulse signals and for generating an end pulse when said counter reaches a predetermined value;

a stop control circuit, operatively connected to said position deviation detecting circuit and said speed signal generating circuit, for receiving the speed signal and the deviation signal and outputting a decelerating signal;

a differential amplifier, operatively connected to said speed signal generating circuit and said target speed setting circuit, for receiving the spacing speed signal and speed signal and outputting an output signal;

a switch operatively connected to said differential amplifier or said stop control circuit, alternatively, in accordance with the end pulse; and an amplifier, operatively connected to said switch, for receiving the output signal or the decelerating signal, alternatively.

9. A control circuit for an adaptive high-speed printer according to claim 7, operatively connectable to an external source providing a selecting signal, wherein said target speed setting circuit further comprises:

an operation circuit, operatively connected to said register and the external source, for receiving the selection amount data signal from said register and the selecting signal from the external source and generating a compensation signal;

a digital-to-analog converter, operatively connected to said operation circuit, for receiving and converting the compensation signal and outputting the spacing speed signal;

an inverter, operatively connected to said digital-to-analog converter, for receiving the spacing speed signal and outputting a signal opposite in polarity;

a level converter, operatively connected to said digital-to-analog converter and said position pulse generating circuit, for receiving the spacing speed signal and outputting a level converted signal to said position pulse generating circuit; and a switch, operatively connected to said inverter or said digital-to-analog converter, for receiving the spacing speed signal or the signal opposite in polarity and outputting the spacing speed signal or the signal opposite in polarity, respectively, to said differential amplifier of said position control circuit.

10. A control circuit for an adaptive high-speed printer according to claim 8, wherein said hammer control circuit comprises a hammer activating signal generating circuit, operatively connected to said position pulse generating circuit, for receiving the position pulse signal and for generating a signal to project said hammering means.

11. A control circuit for an adaptive high-speed printer according to claim 9, wherein said operation circuit comprises:

a decoder operatively connected to receive the selection amount data from the external source;

a plurality of register files, operatively connected to said decoder, for storing the selection amount data and outputting the selection amount data signal;

a multiplexer, operatively connected to said plurality of register files, for receiving the output selection amount data signal and selecting a speed voltage data corresponding to the selected one of the plurality of type elements and outputting a corresponding speed voltage data signal;

a speed difference detection circuit, operatively connected to said multiplexer, for receiving the speed voltage data signal from said multiplexer and outputting a speed difference signal; and a compensating circuit, operatively connected to said speed difference detection circuit and said multiplexer, for receiving the output speed voltage data signal and the speed difference signal and for outputting the compensation signal.

* * * * *

UNITED STATES PATENT AND TRADEMARK OFFICE

CERTIFICATE OF CORRECTION

PATENT NO. : 4,441,832

DATED : APRIL 10, 1984

INVENTOR(S) : MASAHISA NARITA ET AL.

It is certified that error appears in the above-identified patent and that said Letters Patent is hereby corrected as shown below:

Col. 1, line 21, after "shifting" insert --the--;
line 26, delete "said";
line 34, no new paragraph;
line 44, no new paragraph;
line 52, no new paragraph;
line 55, no new paragraph.

Col. 2, line 30, "wheel" should be --wheels--.

Col. 3, line 1, "of the" (second occurrence) should be --circuit 26--;
line 2, delete "major part";
line 23, before "connected" insert --is--;
line 38, "CD" should be --C and D--.

Col. 4, line 15, after "circuit" insert --21--;
line 16, delete "21";
line 51, no new paragraph;
line 56, no new paragraph;
line 62, no new paragraph.

UNITED STATES PATENT AND TRADEMARK OFFICE

CERTIFICATE OF CORRECTION

PATENT NO. : 4,441,832

DATED : APRIL 10, 1984

INVENTOR(S) : MASAHISA NARITA ET AL.

It is certified that error appears in the above-identified patent and that said Letters Patent is hereby corrected as shown below:

Col. 5, line 54, "signal" should be --signal,--.

Col. 6, line 43, "$TR_2$small" should be --$TR_2$ small--.

Col. 7, line 40, after "the" (first occurrence) insert --type--; and delete "of type";
line 45, "signal" should be --signal,--.

Col. 8, line 32, after "the" insert --actual--;
line 38, after "point" insert --K--;
line 39, "to" should be --or--.

Col. 9, line 14, change "," to --)--;
line 41, "(Fig. 6, V)" should be --(Fig. 6, V")--;
line 56, delete "in";
line 64, no new paragraph.

Signed and Sealed this

Eleventh Day of September 1984

[SEAL]

Attest:

GERALD J. MOSSINGHOFF

Attesting Officer

Commissioner of Patents and Trademarks